US009631504B2

(12) United States Patent
Bentley

(10) Patent No.: US 9,631,504 B2
(45) Date of Patent: Apr. 25, 2017

(54) VARIABLE GUIDE VANE EXTENDED VARIABLE FILLET

(71) Applicant: SOLAR TURBINES INCORPORATED, San Diego, CA (US)

(72) Inventor: Sean Joseph Bentley, National City, CA (US)

(73) Assignee: Solar Turbines Incorporated, San Diego, CA (US)

( * ) Notice: Subject to any disclaimer, the term of this patent is extended or adjusted under 35 U.S.C. 154(b) by 488 days.

(21) Appl. No.: 14/243,701

(22) Filed: Apr. 2, 2014

(65) Prior Publication Data

US 2015/0285085 A1 Oct. 8, 2015

(51) Int. Cl.

| | |
|---|---|
| ***F01D 9/02*** | (2006.01) |
| ***F01D 5/14*** | (2006.01) |
| ***F01D 17/16*** | (2006.01) |
| ***F04D 29/56*** | (2006.01) |

(52) U.S. Cl.

CPC ..... *F01D 9/02* (2013.01); *F01D 5/143* (2013.01); *F01D 17/162* (2013.01); *F04D 29/563* (2013.01)

(58) Field of Classification Search

CPC . F01D 5/141; F01D 5/143; F01D 9/02; F01D 17/162; F04D 29/563

See application file for complete search history.

(56) References Cited

U.S. PATENT DOCUMENTS

| | | | | |
|---|---|---|---|---|
| 4,990,056 | A | 2/1991 | McClain et al. | |
| 5,593,275 | A | 1/1997 | Venkatasubbu et al. | |
| 6,283,705 | B1 | 9/2001 | Rice et al. | |
| 6,394,750 | B1 | 5/2002 | Hiskes | |
| 6,450,766 | B1 | 9/2002 | Honda | |
| 6,461,105 | B1 | 10/2002 | Nicolson | |
| 7,125,222 | B2 | 10/2006 | Cormier et al. | |
| 7,249,933 | B2 | 7/2007 | Lee et al. | |
| 7,360,990 | B2 | 4/2008 | Barbe et al. | |
| 7,963,742 | B2 | 6/2011 | Clouse et al. | |
| 2004/0081548 | A1* | 4/2004 | Zess | F01D 5/145 415/1 |
| 2005/0106025 | A1 | 5/2005 | Snook et al. | |
| 2008/0101935 | A1 | 5/2008 | Clouse et al. | |
| 2008/0253882 | A1* | 10/2008 | Major | F01D 5/147 415/148 |
| 2010/0232936 | A1* | 9/2010 | Mielke | F01D 17/162 415/160 |
| 2012/0051927 | A1 | 3/2012 | Lamaster et al. | |
| 2014/0140822 | A1* | 5/2014 | Capozzi | F01D 9/00 415/160 |

FOREIGN PATENT DOCUMENTS

| | | |
|---|---|---|
| EP | 2620602 A2 | 7/2013 |

* cited by examiner

*Primary Examiner* — Audrey K Bradley

(74) *Attorney, Agent, or Firm* — Procopio, Cory, Hargreaves & Savitch, LLP

(57) ABSTRACT

A guide vane is disclosed. The guide vane includes a button, a trunnion connected to the button, and an airfoil connected to the button. The airfoil includes an overhang portion wherein the overhang portion extends from one end of the button to a distal end of the airfoil. The guide vane includes a button corner located near the beginning of the overhang portion. The guide vane includes a variable fillet extending into the overhang portion. The variable fillet includes sections of different radiuses along the length of the fillet.

18 Claims, 4 Drawing Sheets

VARIABLE GUIDE VANE EXTENDED VARIABLE FILLET

TECHNICAL FIELD

The present disclosure generally pertains to gas turbine engines, and is more particularly directed toward a variable guide vane.

BACKGROUND

Gas turbine engines include compressor, combustor, and turbine sections. Compressor guide vanes of a gas turbine engine undergo considerable wear during operation and are subject to high vibrations and stress.

U.S. Pat. No. 7,963,742 to B. Clouse, et al., discloses a stator vane assembly. The stator vane assembly includes at least one button, a vane airfoil adjacent to the button, and a fillet defined between the button and the airfoil. The fillet defines a constant radius and extends beyond the button at least greater than a distance of 60% of a length of an overhang portion of the vane airfoil.

The present disclosure is directed toward overcoming one or more of the problems discovered by the inventors.

SUMMARY OF THE DISCLOSURE

A guide vane is disclosed. The guide vane includes a first button and a first trunnion connected to the first button. The guide vane further includes an airfoil connected to the first button. The airfoil includes a leading edge, a trailing edge, and a first overhang portion. The first overhang portion extends from one end of the first button to a distal end of the airfoil. The guide vane also includes a first button corner located between the airfoil and first button near the beginning of the first overhang portion. The guide vane also includes a first variable fillet extending between the first button and airfoil and extending into the first overhang portion, the first variable fillet including sections of different radiuses.

DETAILED DESCRIPTION

The systems and methods disclosed herein include a guide vane. The guide vane may include a first button, a first trunnion connected to the first button, and an airfoil connected to the first button. The airfoil may include a leading edge, a trailing edge, and a first overhang portion. The first overhang portion extends from one end of the first button to a distal end of the airfoil. The guide vane also includes a first variable fillet extending between the first button and airfoil and extending into the first overhang portion, the first variable fillet including sections of different radiuses. One of the sections of different radiuses is a first bulge located near the first button corner. The first bulge may provide local thickening of the first button corner to decrease vibration and stress. This may prevent cracking and other defects.

Figure 1:
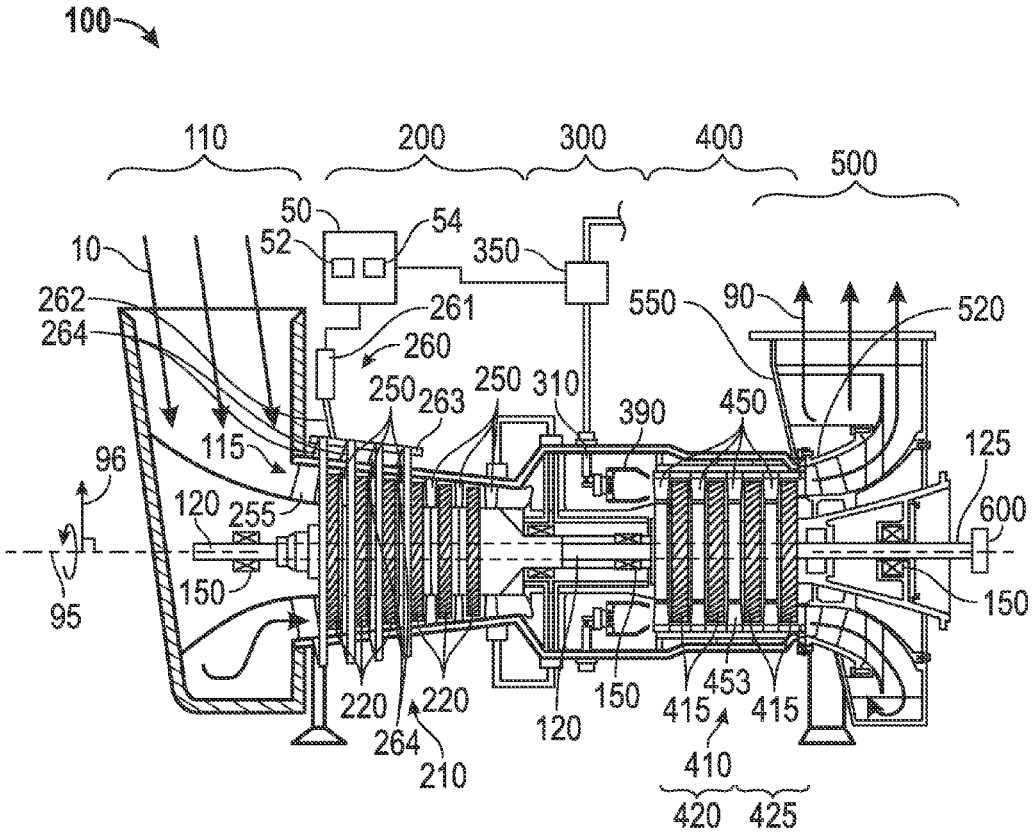
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a gas producer or compressor 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor guide vanes (sometimes referred to as stators or stationary vanes) 250, and inlet guide vanes 255. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Guide vanes 250 axially follow each of the compressor disk assemblies 220. Each compressor disk assembly 220 paired with the adjacent guide vanes 250 that follow the compressor disk assembly 220 is considered a compressor stage. Compressor 200 includes multiple compressor stages. In some embodiments, guide vanes 250 within the first few compressor stages are variable guide vanes. Variable guide vanes may each be rotated about their own axis to control gas flow. Variable guide vanes generally do not rotate circumferentially about center axis 95.

Inlet guide vanes 255 axially precede the compressor stages. Inlet guide vanes 255 may be rotated to modify or control the inlet flow area of the compressor 200 by an actuation system 260. In some embodiments, inlet guide vanes 255 are variable guide vanes and may be rotated about their own axis.

Actuation system 260 includes actuator 261, actuator arm 262, and a linkage system 263. Actuator 261 moves actuator arm 262 that moves or translates the components of the linkage system 263. The linkage system 263 includes linkage arms 264. A linkage arm 264 may be connected to each inlet guide vane 255 and each stator 250 variable guide vane. When actuator arm 262 is moved it causes each linkage arm 264 to be moved and rotate each inlet guide vane 255 and each stator 250 variable guide vane. The actuator 261, actuator arm 262, and linkage arms 264 may be coupled together and configured to rotate each variable guide vane the same amount.

The combustor 300 includes one or more injectors 310 and includes one or more combustion chambers 390.

The turbine 400 includes a turbine rotor assembly 410, turbine disk assemblies 420, and turbine nozzles 450.

Figure 2:
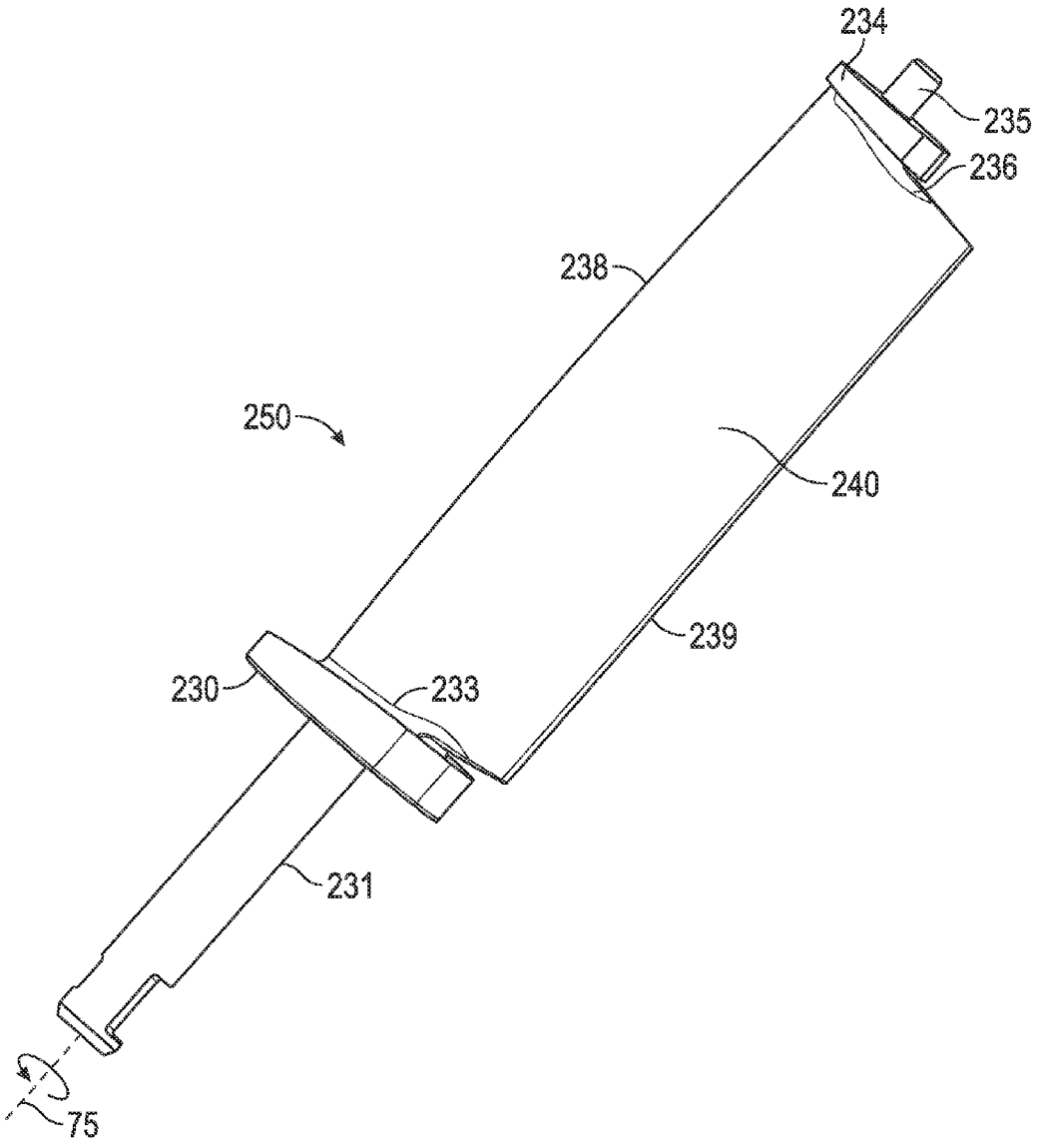
FIG. 2 is a perspective view of an embodiment of a guide vane.

FIG. 2 depicts a perspective view of an embodiment of a guide vane 250. The guide vane 250 may include an inner button 230, an outer button 234, an airfoil 240, an inner trunnion 231, and an outer trunnion 235. Inner button 230, outer button 234, inner trunnion 231, and outer trunnion 235 may sometimes hereinafter be referred to as first button, second button, first trunnion, and second trunnion, respectively. The guide vane 250 may also include a vane axis 75 of rotation of the guide vane 250, which may be generally defined by the longitudinal axis of inner trunnion 231. All references to radial, axial, and circumferential directions and measures in relation to parts of the guide vane 250 may refer to vane axis 75.

As illustrated in the figure, inner button 230 and outer button 234 may be a cylindrical platform including an outer cylindrical surface, a top surface, and a bottom surface opposite the top surface. Airfoil 240 may extend in a first direction from the top surface of inner button 230. In some embodiments, the airfoil 240 extends axially outwards from the top surface of inner button 230. Inner trunnion 231 may extend in a second direction from the bottom surface of inner button 230, opposite the first direction of the airfoil 240. In some embodiments, inner trunnion 231 extends outwards from the bottom surface of inner button 230 in an axial direction opposite the airfoil 240. Inner trunnion 231 may be a support structure and may be used for rotation of the guide vane 250. Airfoil 240 may extend to the bottom surface of outer button 234. Outer trunnion 235 may extend in the first direction, or axial direction, from the top surface of outer button 234, in a similar fashion as inner button 230 and inner trunnion 231.

An inner fillet 233 (sometimes referred to as first fillet) may form a curved extrusion extending between the top surface of inner button 230 and airfoil 240. An outer fillet 236 (sometimes referred to as second fillet or outer variable fillet) may form a curved extrusion extending between the bottom surface of outer button 234 and airfoil 240. In preferred embodiments, both inner fillet 233 and outer fillet 236 are variable fillets. Both fillets may be a concave curved extrusion. Variable fillets, as explained in FIG. 3 below, may include different or varying radiuses along the extruded length of the fillet.

Figure 3:
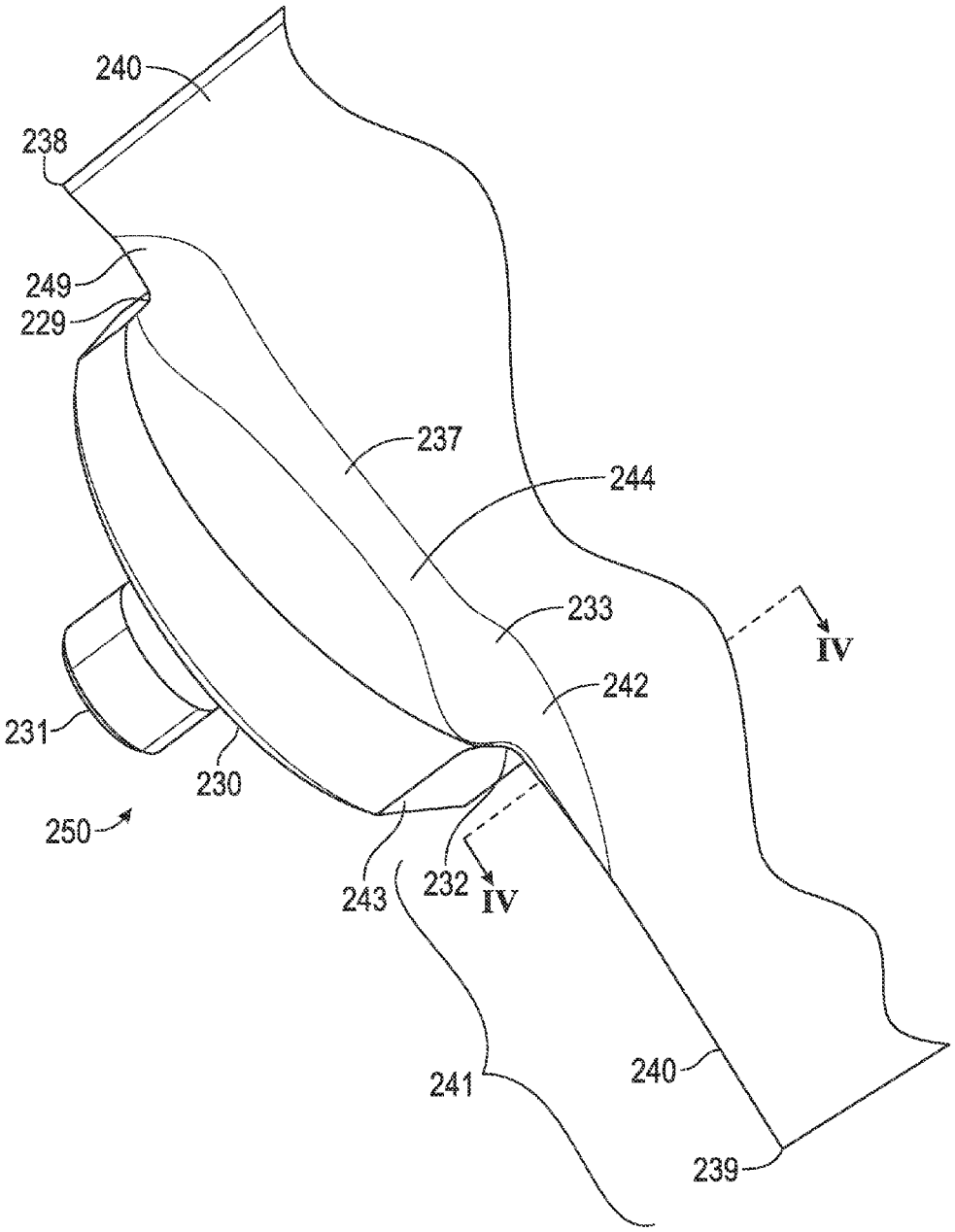
FIG. 3 is an enlarged perspective view of a portion of the guide vane depicted in FIG. 2.

FIG. 3 depicts an enlarged perspective view of a portion of the guide vane 250 depicted in FIG. 2. A transition area 244 may represent the adjoining area of the top surface of inner button 230 and the bottom surface of airfoil 240. Airfoil 240 may extend radially from a leading edge 238 to a trailing edge 239. In some embodiments, inner fillet 233 (hereinafter may be referred to as variable fillet 233 or inner variable fillet 233) may extend at least the entire length of transition area 244. Variable fillet 233 may also extend further than the length of transition area 244 towards leading edge 238 or trailing edge 239, or both.

Variable fillet 233 may extend a certain distance into an overhang portion (sometimes referred to as inner overhang portion) 241 of airfoil 240. Overhang portion 241 of the airfoil 240 may include the region of the airfoil 240 extending from a button face 243 to trailing edge 239 of the airfoil 240. Button face 243 may be a circumferential end of the button. In some instances, button face 243 may be flat. In some instances, variable fillet 233 may extend less than 50% the length of the overhang portion 241. By extending less than 50% the length of the overhang portion 241, a termination point of variable fillet 233 terminates at a location less than 50% of the length of the overhang portion 241. The termination point may be one end of variable fillet 233. In other instances, variable fillet 233 extends less than 40% the length of the overhang portion 241. In other instances, variable fillet 233 extends less than 33% the length of the overhang portion 241. In other instances, variable fillet 233 extends less than 25% the length of the overhang portion 241. In other instances, variable fillet 233 extends less than 20% the length of the overhang portion 241. In other instances, variable fillet 233 extends less than 10% the length of the overhang portion 241. In other instances, variable fillet 233 extends less than 5% the length of the overhang portion 241.

The intersection of the button face 243 and the overhang portion 241 may form a button corner 232 (sometimes referred to as inner button corner). During operation, defects such as cracks may form in the button corner 232 due to high vibration and high stress. In certain embodiments, variable fillet 233 may aid in reducing such vibration and stress.

In some embodiments, a leading button corner 229 may form on the other side of button 230 opposite button corner 232 (leading button corner 229 may form on the same side as leading edge 238, whereas button corner 232 may form on the same side as trailing edge 239). Furthermore, an outer button corner (not pictured) may form between outer button 234 an airfoil 240. Variable fillet 233 may extend past leading button corner 229 towards leading edge 238. In some embodiments, variable fillet 233 extends less than 50% the length of the airfoil between leading button corner 229 and leading edge 238.

In alternative embodiments, variable fillet may extend in limited segments within transition area 244. In other embodiments, variable fillet may extend in a limited segment encompassing the button corner.

Variable fillet 233 may be a curved extrusion wherein the radius of the curvature of the extrusion varies along the length of the fillet. Certain sections of variable fillet 233 may be thicker than other sections. Such sections may strengthen the variable fillet 233 and prevent cracks from forming. In certain embodiments, a thicker section of the variable fillet 233 forms a bulge 242. Bulge 242 may be a rapidly expanding thicker section where the bottom of the fillet rapidly expands across bulge 242. Variable fillet 233 may also taper, such as in a narrow section 237, to allow for increased airflow, or to minimize material cost. Narrow section may be located within a portion of the fillet distal from bulge 242. Variable fillet 233 may taper and expand gradually throughout any section of the fillet including narrow section 237 and bulge 242. In preferred embodiments, a thicker section forms at both ends of transition area 233. Bulge 242 may form proximal button corner 232, and leading bulge (sometimes referred to as second bulge) 249 may form proximal leading button corner 229.

In certain embodiments, button face 243 may be flat. This may provide clearance for installation of the guide vane.

Figure 4:
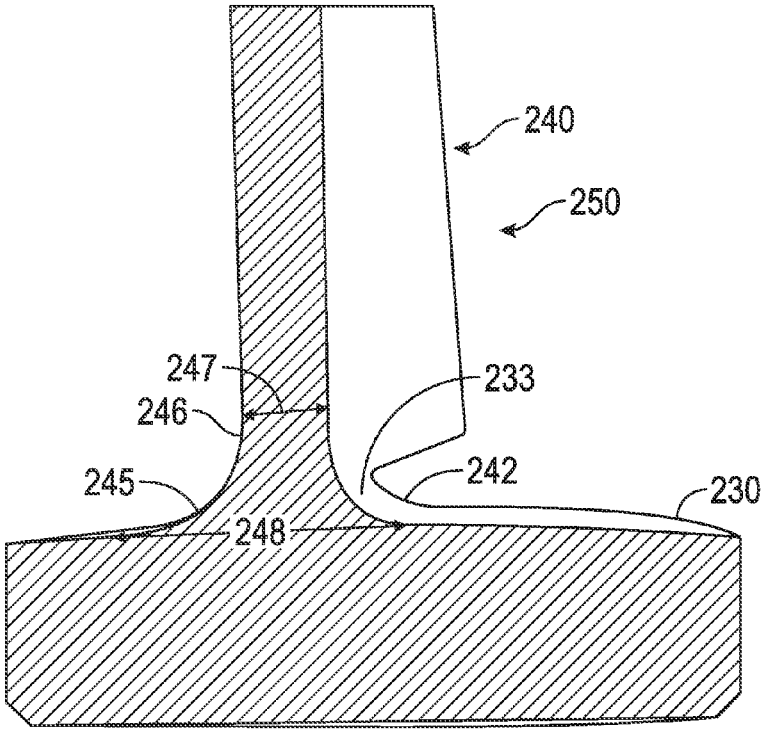
FIG. 4 is a cross-sectional perspective view taken along line IV-IV of FIG. 3.

FIG. 4 is a cross-sectional perspective view taken along line IV-IV of FIG. 3. The cross section is taken in the bulge 242 of the variable fillet 233. The perspective view is at a slight angle to illustrate the variable fillet and the airfoil. In some embodiments, variable fillet 233 may be a conic fillet or an elliptical fillet, and extrude with a conical or elliptical curvature along the length of the fillet. Furthermore, conic fillets may include a curvature of smooth, continuously fluctuating radii. Conic fillets may include a curvature representing any cross section cut of a cone. Elliptical fillets may be a type of conic fillet further including a linear eccentricity. Elliptical fillets may include curvature with a major axis, a minor axis, and two foci, in which the two foci are two special points on an ellipse's major axis that are equidistant from the center point of the ellipse. The linear eccentricity of an ellipse, sometimes denoted by e, is the ratio of the distance between the two foci, to the length of the major axis. The sum of the distances from any point on the ellipse to those two foci is constant and equal to the major axis. All ellipses have an eccentricity between 0 and 1 ($0<e<1$), wherein as e approaches 1, the ellipse becomes a more elongated shape.

In some embodiments, variable fillet 233 is a compound fillet as illustrated in FIG. 4. Compound fillets may consist of a lower curve 245 and an upper curve 246. In some embodiments, lower curve 245 may include a greater radius than upper curve 246. In other embodiments, lower curve 245 may include a lesser radius than upper curve 246. Furthermore, in certain instances, lower curve 245 may include a radius 10% of the radius of upper curve 246. In other instances, lower curve 245 may include a radius 5-50% of the radius of upper curve 246.

As the variable fillet 233 extends radially from one end to the other, the radius of the lower curve 245 and upper curve 246 may vary proportionally. For example, in comparison to the cross section in the bulge area as discussed above, a cross section in the narrow section 237 of the variable fillet may include a proportionately smaller radius in the lower curve and upper curve.

Airfoil 240 may include an airfoil base width 247 (sometimes referred to as inner airfoil base width 247) at the intersection of variable fillet 233 and airfoil 240. The width of the airfoil may expand to a fillet base width 248 (sometimes referred to as inner fillet base width 248) at the inner surface of variable fillet 233. In some embodiments, fillet base width 248 may be 20-150% wider than airfoil base width 247. In further embodiments, fillet base width 248 may be 90-120% wider than airfoil base width 247.

In certain embodiments, variable fillet 233 extrudes with a circular curvature along the length of the fillet. In such embodiments, the radius of upper curve and lower curve is the same at any cross section along the fillet.

Figure 5:
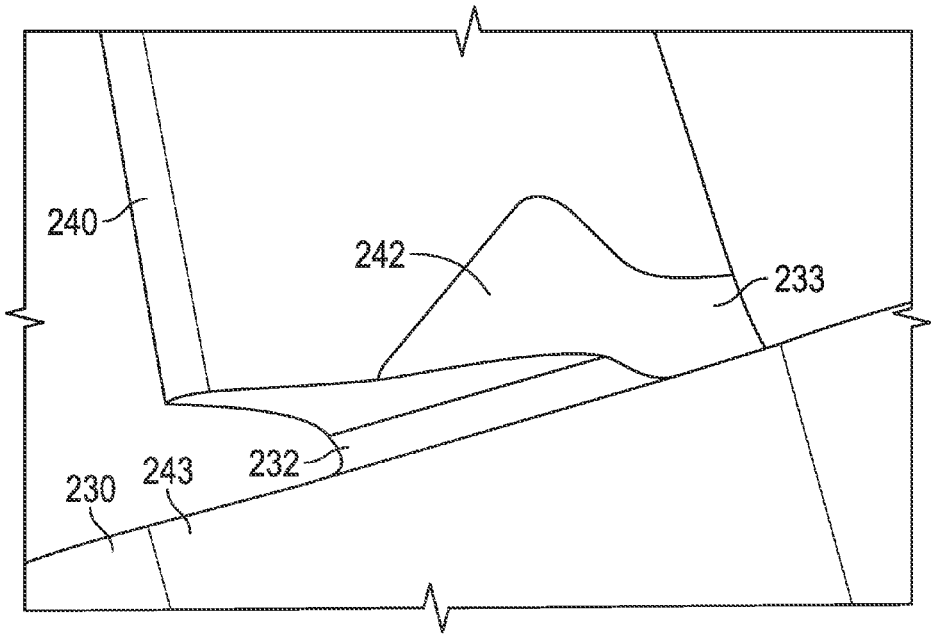
FIG. 5 is an enlarged perspective view of a portion of the guide vane depicted in FIG. 2.

FIG. 5 depicts an enlarged perspective view of a portion of the guide vane depicted in FIG. 2. In some embodiments, button corner 232 may include a chamfer. In other embodiments, button corner 232 may include a rounded edge.

Although not pictured, outer button 234 and outer fillet 236 may include similar features as inner button 230 and inner fillet 233. For example, outer fillet 236 may extend a certain distance into an outer overhang portion. In some instances, outer fillet 236 may extend less than 50% the length of outer overhang portion. Airfoil 240 may include an outer airfoil base width at the intersection of outer fillet 236 and airfoil 240, which may expand to an outer fillet base width at the outer surface of outer fillet 236.

One or more of the above components (or their subcomponents) may be made from a base material that is stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance.

Superalloys may include materials such as alloy x, WASPALOY, RENE alloys, alloy 188, alloy 230, alloy 17-4PH, INCOLOY, INCONEL, MP98T, TMS alloys, and CMSX single crystal alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Guide vanes may be susceptible to cracks from high vibrations and high stresses during operation. In particular, areas of intersection between structural parts may create vulnerabilities. As illustrated in FIG. 3, the button corner 232 between the button face 243 and the overhang portion 241 of the airfoil 240 may be highly susceptible to vibrations. This may lead to cracking and failure of the guide vane. Local thickening between the button and airfoil can provide relief. Variable fillet 233 may include a thickening that reduces local stress and vibration in the button corner 232. Variable fillet 233 may include a larger local thickening area such as bulge 242. Along with reducing vibrations and stress, bulge 242 may also increase or aid in tuning the modal response frequency. Variable fillet 233 may also include tapered sections such as narrow section 237. Narrow section 237 may allow for increased local airflow while still providing structural support. Narrower section 237 may decrease efficiency loss within the compressor, as well as provide more efficient use of raw material. Narrow section 237 may also provide better castability or machining during manufacture of the guide vane.

Variable fillet 233 may, in some instances, be an elliptical fillet as described above. Elliptical fillets may provide for more efficient use of material and provide better castability or machining of the guide vane. Furthermore, elliptical fillets may provide for improved design of variable fillet 233. For example, as depicted in FIG. 4, a cross section of the guide vane 250 may depict the bi-directional curvature of variable fillet 233. In embodiments where variable fillet 233 is an elliptical fillet, the lower curve 245 of the fillet may be a factor larger than upper curve 246 of the fillet. In such embodiments, the elliptical fillet allows for reduced material around the upper curve 246, where local thickening may not be as significant. Furthermore, the elliptical fillet may also allow for increased airflow around the upper curve 246 and decrease efficiency loss.

The preceding detailed description is merely exemplary in nature and is not intended to limit the invention or the application and uses of the invention. The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A guide vane comprising:

a first button;

a first trunnion connected to the first button;

an airfoil connected to the first button, the airfoil including a leading edge, a trailing edge, and a first overhang portion, wherein the first overhang portion extends from one end of the first button toward the trailing edge of the airfoil;

a first button corner located between the airfoil and the first button adjacent the first overhang portion; and a first variable fillet extending between the first button and the airfoil and extending into the first overhang portion, the first variable fillet including sections of different radiuses along an extruded length of the fillet, wherein one of the sections of different radiuses comprises a first bulge located proximal the first button corner.

2. The guide vane of claim 1, wherein the first variable fillet extends less than 50% of a length of the first overhang portion.

3. The guide vane of claim 1, wherein the first variable fillet extends less than 20% of a length of the first overhang portion.

4. The guide vane of claim 1, wherein the first variable fillet is a conic fillet further including a curvature of smooth, continuously fluctuating radii.

5. The guide vane of claim 1, wherein the first variable fillet is a compound fillet, the compound fillet including a lower curve and an upper curve, and the lower curve including a radius lesser than the upper curve.

6. The guide vane of claim 1, wherein the first variable fillet includes a narrow section located within a portion of the fillet distal from the first bulge.

7. The guide vane of claim 1, wherein the airfoil includes an airfoil base width, the first variable fillet includes a first fillet base width, and the first fillet base width is 20-150% wider than the airfoil base width within the first bulge.

8. The guide vane of claim 1, wherein the first bulge increases modal response frequency in the first button corner.

9. The guide vane of claim 1, further comprising:

a second button connected to the airfoil; and a second variable fillet extending between the second button and the airfoil into a second overhang portion, the second overhang portion extending from one end of the second button toward the trailing edge of the airfoil, wherein the second variable fillet includes sections of different radiuses, wherein one of the sections of different radiuses includes a second bulge located adjacent the second button corner, the second button corner located between the airfoil and the second button adjacent the second overhang portion.

10. A guide vane comprising:

an inner button and an outer button;

an inner trunnion extending axially outward from the inner button, and an outer trunnion extending axially outwards from outer button;

an airfoil extending axially between the inner button and outer button, the airfoil including an inner overhang portion and an outer overhang portion, wherein the inner overhang portion extends radially from one end of the inner button to a distal end of the airfoil, and the outer overhang portion extends radially from one end of the outer button to a distal end of the airfoil;

an inner button corner located between the airfoil and inner button adjacent the inner overhang portion, and an outer button corner located between the airfoil and outer button adjacent the outer overhang portion;

an inner fillet extending radially between the inner button and airfoil and extending radially into the inner overhang portion;

an outer fillet extending radially between the outer button and airfoil and extending radially into the outer overhang portion;

wherein the airfoil includes an inner airfoil base width and an outer airfoil base width, the inner fillet includes an inner fillet base width, and the outer fillet includes an outer fillet base width; and a first bulge located proximal the inner button corner; and a second bulge located proximal the outer button corner.

11. The guide vane of claim 10, wherein within the first bulge, the inner fillet base width is 20-150% wider than the inner airfoil base width, and wherein within the second bulge, the outer fillet base width is 20-150% wider than the outer airfoil base width.

12. The guide vane of claim 10, wherein the inner fillet and outer fillet include sections of different radiuses.

13. The guide vane of claim 10, further comprising a leading button corner located between the airfoil and inner button opposite the inner button corner, wherein the inner fillet extends into the leading button corner.

14. A compressor of a gas turbine engine comprising:

a compressor disk assembly;

a guide vane adjacent the compressor disk assembly, the guide vane including:

an inner button and an outer button;

an inner trunnion and outer trunnion connected to the inner button and outer button respectively;

an airfoil located between the inner button and outer button, the airfoil including a leading edge, a trailing edge, an inner overhang portion, and an outer overhang portion, wherein the inner overhang portion extends from one end of the inner button to the trailing edge of the airfoil, and the outer overhang portion extends from one end of the outer button to the trailing edge of the airfoil;

an inner button corner located between the airfoil and the inner button adjacent the inner overhang portion, and an outer button corner located between the airfoil and the outer button adjacent the outer overhang portion;

an inner variable fillet extending between the inner button and airfoil and extending into the inner overhang portion, the inner variable fillet including sections of different radiuses;

an outer variable fillet extending between the outer button and airfoil and extending into the outer overhang portion, the outer variable fillet including sections of different radiuses;

wherein the airfoil includes an inner airfoil base width and an outer airfoil base width, the inner variable fillet includes an inner fillet base width, and the outer variable fillet includes an outer fillet base width;

a first bulge located proximal the inner button corner; and a second bulge located proximal the outer button corner.

15. The compressor of claim 14, wherein the inner variable fillet extends less than 50% of a length of the inner overhang portion, and the outer variable fillet extends less than 50% of a length of the outer overhang portion.

16. The compressor of claim 14, wherein the inner variable fillet and outer variable fillet are conic fillets further including a curvature of smooth, continuously fluctuating radii.

17. The compressor of claim 14, wherein the inner variable fillet and outer variable fillet are compound fillets, each compound fillet including a lower curve and an upper curve, and the lower curve including a radius lesser than the upper curve.

18. The compressor of claim 14, wherein the inner fillet base width is 20-150% wider than the inner airfoil base width within the first bulge, and the outer fillet base width is 20-150% wider than the outer airfoil base width within the second bulge.

* * * * *